US010271645B2

(12) United States Patent
Davis

(10) Patent No.: US 10,271,645 B2
(45) Date of Patent: Apr. 30, 2019

(54) MODULAR EXPANDABLE AUXILIARY REFRIGERATION CONTAINER

(71) Applicant: Camden Ronald Davis, Beverly Hills, FL (US)

(72) Inventor: Camden Ronald Davis, Beverly Hills, FL (US)

( * ) Notice: Subject to any disclaimer, the term of this patent is extended or adjusted under 35 U.S.C. 154(b) by 0 days.

(21) Appl. No.: 15/426,076

(22) Filed: Feb. 7, 2017

(65) Prior Publication Data

US 2018/0224202 A1 Aug. 9, 2018

(51) Int. Cl.

| | |
|---|---|
| ***A47B 88/407*** | (2017.01) |
| ***A47B 71/00*** | (2006.01) |
| ***F25D 23/06*** | (2006.01) |
| *F25D 25/02* | (2006.01) |

(52) U.S. Cl.

CPC ..... *A47B 71/00* (2013.01); *A47B 88/407* (2017.01); *F25D 23/067* (2013.01); *F25D 25/025* (2013.01)

(58) Field of Classification Search

CPC ..... F25D 25/005; A47B 71/00; A47B 88/407

USPC ..... 312/401, 404, 408, 294, 319.1

See application file for complete search history.

(56) References Cited

U.S. PATENT DOCUMENTS

| | | | | |
|---|---|---|---|---|
| 5,004,306 | A * | 4/1991 | Oshida | A47B 88/487 312/319.1 |
| 5,228,570 | A * | 7/1993 | Robinson | B25H 3/06 206/375 |
| 5,562,217 | A * | 10/1996 | Salveson | A47F 1/126 211/175 |
| 6,386,659 | B1 * | 5/2002 | Muller | A47B 88/402 312/334.38 |
| 6,488,151 | B2 * | 12/2002 | Ramsey | B25H 3/06 206/378 |
| 6,883,884 | B2 * | 4/2005 | Chen | E05C 3/14 312/333 |
| 7,364,244 | B2 * | 4/2008 | Sandoval | H05K 7/1411 312/333 |
| 2003/0010732 | A1 * | 1/2003 | Burke | A47F 1/126 211/59.3 |
| 2005/0199563 | A1 * | 9/2005 | Richter | A47F 1/126 211/59.3 |
| 2010/0109496 | A1 * | 5/2010 | Grasy | F25D 23/04 312/404 |
| 2016/0324317 | A1 * | 11/2016 | Chen | H05K 7/1489 |

* cited by examiner

*Primary Examiner* — James O Hansen
(74) *Attorney, Agent, or Firm* — Patent CEO, LLC; Phillip Vales

(57) ABSTRACT

A carriage is moveably supported upon a track for storage of food items therein. The track acts as sliding surface for the carriage that itself facilitates users accessibility to the items therein. An integral gripping end and an adjustable grip are situated at opposite ends of the track; these provide easy placement and engagement of the device upon a shelf within a refrigerator.

5 Claims, 4 Drawing Sheets

MODULAR EXPANDABLE AUXILIARY REFRIGERATION CONTAINER

FIELD OF THE INVENTION

The present invention relates to devices used in conjunction with refrigerators. More particularly, the present invention relates to supplemental refrigeration storage and arrangement devices therefore.

BACKGROUND OF THE INVENTION

A refrigerator has various shelves, drawers, storage zones under flaps, tracks and similar devices arranged about the internal storage space thereof. Most typically also provide storage space on the main refrigerator door for condiment dispensers, commonly consumed liquids in liter or gallon containers and similar items.

All of these are supposed to enable an end user to place pre-packaged containers housing food and liquid items therein for future use; a user may also supplement the pre-packaged containers with user provided plastic storage or similar devices. It is typical that all of the aforementioned containers are shaped and sized in dissimilar ways such that variety of packaging actually works against their daily storage and use.

For example, a square container abutting a circular one against a small can and so forth does not facilitate the ordered positioning within the storage space within the refrigerator. Thus, a user is left with a situation whereby the many items within the refrigerator are scattered about and inappropriately distributed due to the aforementioned.

An additional problem with existing kitchen drawers is that they are not fully extendible. Many of them also have rollers or similar devices for assisting in the sliding action but that add to the complexity thereof.

Thus, one would wish to provide a cost effective, easy to use solution that organizes the interior space of the refrigerator beyond the capabilities of the current manufacturer specification whilst operating within the framework of the existing refrigerator. Further, one would like to have a fully extendible solution that does not have rollers or similar such devices.

SUMMARY OF THE INVENTION

The present invention overcomes the deficiencies of the known art and the problems that remain unsolved by providing a Modular Expandable Auxiliary Refrigeration Container.

A refrigerator containment system comprising:
- a track having:
  - a base having a top surface bordered by:
    - an integral first wall immovably disposed and integral with respect to a first side of the base; and
    - an integral second wall immovably disposed and integral with respect to a second side of the base opposite the first wall;
  - an adjustable grip moveably attached to the track at a first end thereof between the first integral and second integral walls; and
- a carriage moveably attached to the track between the first integral wall and the second integral wall so that the carriage is bounded by the integral first wall and the integral second wall;

- a fixed gripping end integrally attached to the base at a second end of the track opposite the first end having the adjustable grip moveably attached thereto;
- a hole in the base wherein the carriage is moveably attached to the base using a T shaped mount;
- a fastener moveably attaching
  - a bottom of the carriage through the hole in the base.

A refrigerator containment system comprising:
- a track having:
  - a base having a top surface bordered by:
    - an integral first wall immovably disposed and integral with respect to a first side of the base; and
    - an integral second wall immovably disposed and integral with respect to a second side of the base opposite the first wall;
  - an adjustable grip moveably attached to the track at a first end thereof between the first integral and second integral walls; and
- a carriage moveably attached to the track between the first integral wall and the second integral wall so that the carriage is bounded by the integral first wall and the integral second wall;
- a mouth on a side of the track within which the adjustable grip is inserted wherein the mouth is formed between the first and second side walls that descend down about a bottom surface of the base that is opposite the top surface of the base; and a first and a second ledge extending inwards towards each other wherein the first ledge is integral with and extends inwards from the first side wall and the second ledge is integral with and extends inwards from the first side wall;
- a first spring attachment support attached to the first ledge.

In another aspect,
- a first spring attached to the first spring attachment support and to the adjustable grip.

In another aspect,
- a second spring attachment support attached to the second ledge.

In another aspect,
- a second spring attached to the second spring attachment support and to the adjustable grip.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1A:
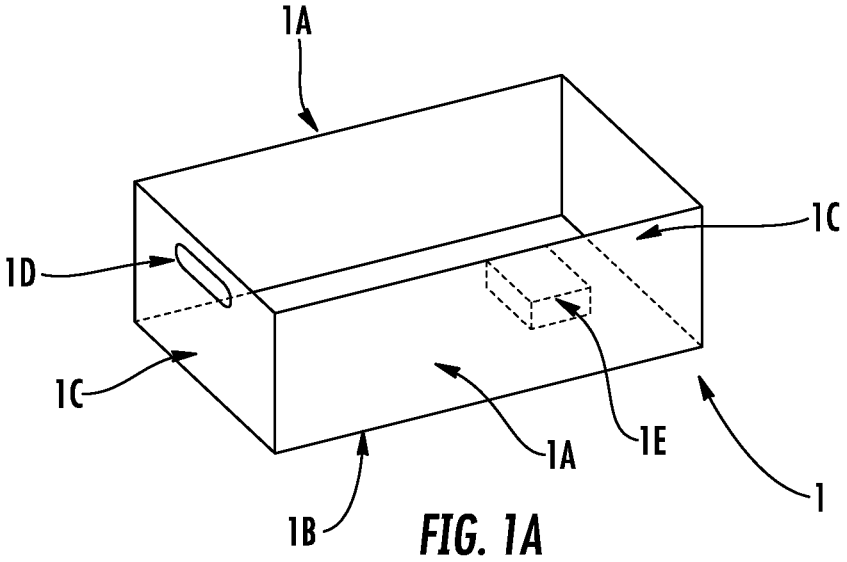
FIG. 1A presents an isometric view of a carriage utilized upon a track in an embodiment taught herein.

FIG. 1A presents an isometric view of a carriage utilized upon a track in an embodiment taught herein. A generally rectangular carriage 1 is shown in the figure having four integral sides 1A, 1A, 1C, 1C along with an integral bottom 1B. Two parallel rectangular longitudinal sides 1A each integrate at an appropriate left edge thereof with a different and opposing edge of a smaller rectangular or square side 1C at the left of the carriage 1. Similarly, the two parallel rectangular sides 1A each integrate at an appropriate right edge thereof with a different and opposing edge of a smaller rectangular or square side 1C at the right of the carriage.

Each of the four integral sides 1A, 1A, 1C, 1C integrate along an underside edge of each to one of four edges of the bottom 1B thereby forming a container for the placement of food items therein. A small grip hole 1D is present in the left 1C of the carriage 1. This carriage 1 translates along the working surface of the track 2 described in FIG. 1B thereby facilitating food accessibility within the carriage 1. An integral square raised protrusion 1E extends out of the underside of the bottom 1B; this is utilized in conjunction with another fastener 1G shown in FIG. 1F for attaching the carriage 1 to the track 2 through a hole 2C in the track 2.

Figure 1B:
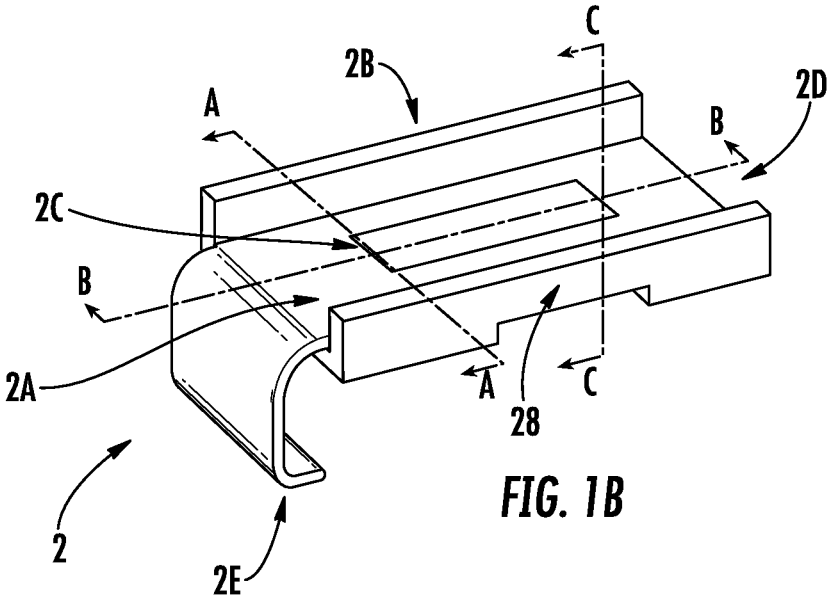
FIG. 1B presents an isometric view of a track used in conjunction with the carriage from FIG. 1A in an embodiment taught herein.

FIG. 1B presents an isometric view of a track 2 used in conjunction with the carriage 1 from FIG. 1A in an embodiment taught herein. A track 2 is used to carry the carriage 1 thereon. Its primary working surface is a base 2A upon which a carriage 1 slides. Integrally attached to the base 2A are two oppositely disposed lateral longitudinal walls 2B arranged perpendicular to the base 2A. Alternatively, these are constructed from separate components attached thereto; these are attachable using glue, adhesive, heat treatment, screws, fasteners or similar modalities. The lateral longitudinal walls 2B each extend about and underneath a portion of the base 2A as one piece forming a dual surface ledge and mouth underneath the base 2A; alternatively this may be formed from several components as described herein.

The track 2 has a left integral gripping end 2E formed from the base 2A of the track 2 such that gripping end 2E extends outwards then straight down and finally makes a sharp turn back towards the track 2. This gripping end 2E along with adjustable grip 3 enables a user to engage a refrigerator shelf at each end surface thereof. Thus, an end surface of a refrigerator shelf is placed against a back portion of the gripping end 2E nearest the track 2; similarly, an opposite end surface of the refrigerator shelf is placed against a back portion of the adjustable grip 3 nearest the track 2.

To accomplish this, a user places the gripping end 2E forward so that a back portion of the gripping end 2E abuts a forward edge of a shelf or similar surface within a refrigerator. A user would then position the back surface (surface closest to track) of the adjustable spring actuated adjustable grip 3 to the rear edge of the shelf thereby grabbing the shelf between the two. Thus, the device disposed in this fashion can engage various sizes of shelves as the grip 3 is spring adjustable. Alternatively, the back (surface closest to track) of the gripping end 2E abuts the rear edge of the shelf whilst the back (surface closest to track) of the adjustable grip 3 abuts the forward edge of the shelf.

To permit the sliding action of the carriage 1 upon the base 2A of the track 2, a fastener 1G is first placed through a threaded hole in a mount 1F. Then the fastener 1G proceeds through a threaded hole in the protrusion 1E that itself sits within the rectangular hole 2C in the base 2A; this thereby locks the mount 1F to the protrusion 1E and concomitantly ensures that the carriage 1 is moveably attached to the track 2 as the protrusion 1E slides within the hole 2C in the base 2A. It should be understood that the mount 1F forms the top portion of a T shape as it engages a bottom of the base 2A by extending beyond the dimensions of the hole 2C to both sides thereof; of course, this has the effect of forbidding disengagement therefrom. It should be apparent that while the mount 1F forms the top portion of the T shape, the protrusion 1E forms the central pillar thereof. As a result, the carriage 1 is now moveably attached to track 2.

Figure 1C:
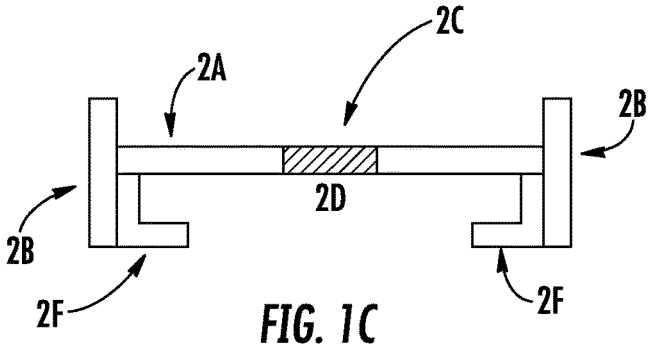
FIG. 1C presents a side cross section view at lines 'C' of a track from FIG. 1B used in conjunction with the carriage from FIG. 1A in an embodiment taught herein.

FIG. 1C presents a side cross section view at lines 'C' of a track from FIG. 1B used in conjunction with the carriage from FIG. 1A in an embodiment taught herein. The track 2 has a hole 2C through a portion of the base 2A. To facilitate the attachment of the track 2 to a shelf or similar surface in a refrigerator, a user inserts a top surface 3A of the adjustable spring activated grip 3 into a mouth 2D formed from the dual surface ledge (formed from holders 2F) of the lateral longitudinal side walls 2B that extend about and beyond the base 2A and then underneath the base 2A as an integral piece. Alternatively, the device is formed from a separate component as taught herein.

In this alternative teaching, the lateral longitudinal walls 2B extend about and beyond but not under the bottom of the base 2A. To create a mouth 2D from opposing dual surface ledges requires the addition of L shaped holders 2F that run along a portion of the underside of the base 2A. These are each attached to an inside surface of one of the lateral longitudinal walls 2B along the vertical portion of the L shape as well as each being attached at a top portion of the L shape to the bottom of the base 2A. In the original integral teaching, the components 2B and 2F would be a single unitary device that attaches to the base 2A; applying further integration would make the base 2A, walls 2B and holders 2F into a single unit.

Figure 1D:
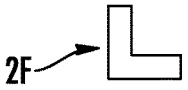
FIG. 1D presents a side cross section view of a holder from FIG. 1C used in conjunction with the adjustable grip from FIG. 1E in an embodiment taught herein.
Figure 1E:
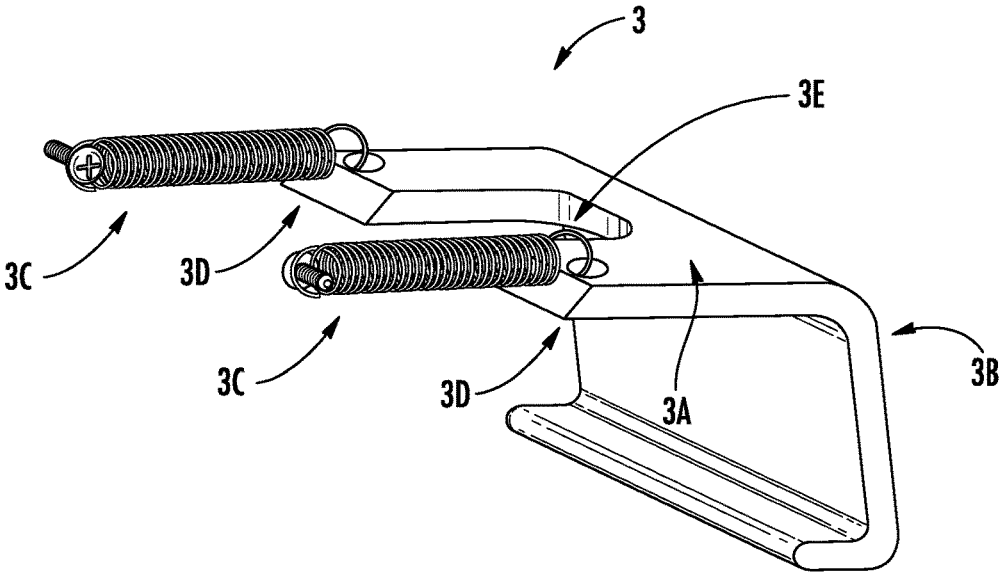
FIG. 1E presents a perspective view of a spring activated adjustable grip in an embodiment taught herein.

FIG. 1D presents a front side cross section view of a holder 2F used in conjunction with the grip 3 from FIG. 1E in an embodiment taught herein. The holders 2F are each attached to an inside surface of one of the lateral longitudinal walls 2B as well as each being attached at a top portion of the L shape to the bottom of the base 2A. Alternatively, the components 2B and 2F would be one device forming a single unitary device that attaches to the base 2A; applying further integration would make the base 2A, walls 2B and holders 2F into a single unit.

FIG. 1E presents a perspective view of an adjustable spring activated grip in an embodiment taught herein. The adjustable spring activated grip 3 is essentially a device utilized to grip the edge of a shelf or similar surface within a refrigerator. The grip is made from a single piece of plastic starting with a flat surface 3A integrally formed with a downward descending portion 3B that finally curves back to a small surface parallel to the top flat surface 3A. The back portion of descending portion 3B engages an edge of a shelf or similar surface in a refrigerator. Two springs 3C are attached to the top flat surface 3A.

Each of these springs 3C has one end thereof attached to a small hole 3D in opposite forward portions of the top flat surface 3A. The springs 3C are attached by wrapping there ends about this hole 3D. This attachment is effected through the use of glue, heat treatment of the plastic to melt about the end of the springs 3C or through the use of a screw inserted within the hole 3D in a thread. Alternatively, the screws are glued to the hole 3D at each opposite forward portion of top flat surface 3A of grip 3 such that each screw has a single end of one spring wrapped about its head.

Figure 1F:
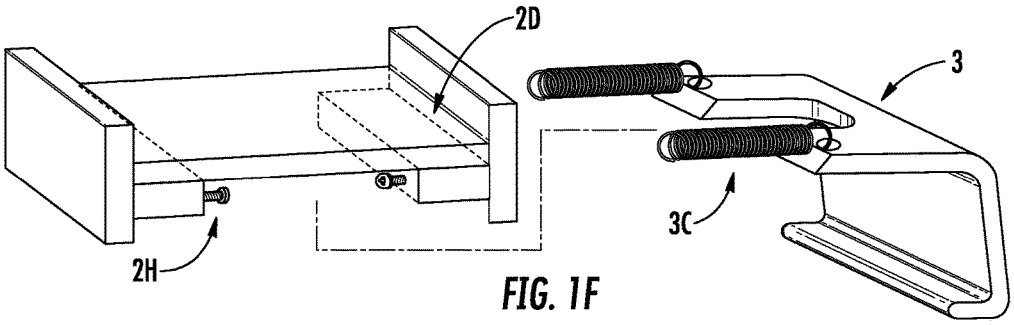
FIG. 1F presents a perspective view of a spring activated adjustable grip used along with the track of FIG. 1B in an embodiment taught herein.
Figure 1G:
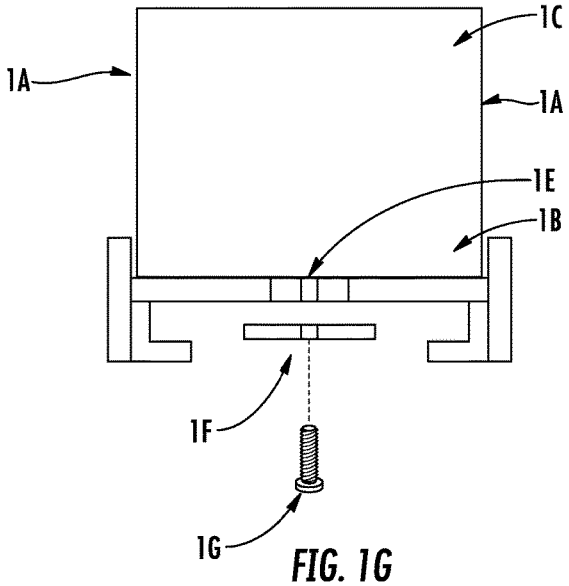
FIG. 1G presents a side cross section view of the carriage of FIG. 1A mounted on the track of FIG. 1B along section cut 'C' showing an attachment device attached to the carriage through a hole in the track such that this is used to facilitate the sliding function in an embodiment taught herein.
Figure 1H:
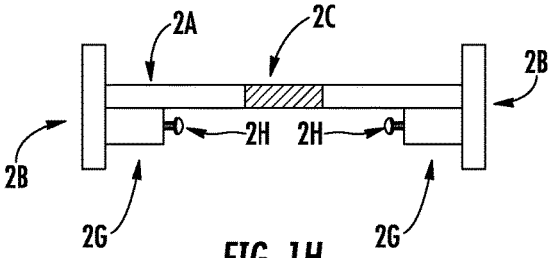
FIG. 1H presents a cross section view at lines 'A' of a track from FIG. 1B used in conjunction with the carriage from FIG. 1A in an embodiment taught herein.
Figure 1I:
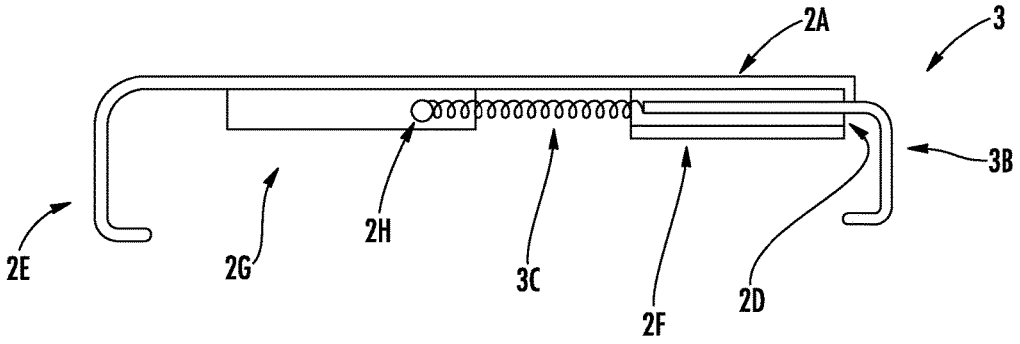
FIG. 1I presents a cross section view at lines 'B' of a track from FIG. 1B used in conjunction with the carriage from FIG. 1A in an embodiment taught herein.

The other end of each spring 3C is to be similarly attached under the track 2 (as shown in FIG. 1F and FIG. 1I) so that each spring 3C is parallel to one another and running along underneath the track 2. Care should be taken to ensure that the springs 3C have sufficient tension therein to allow for it to engage the end of the aforementioned shelf or similar refrigerator surface. Between the opposite forward portions of the grip 3 is a large space 3E that is cutout of top flat surface 3A; as the top flat surface 3A slides in and out of mouth 2D it could encounter the protrusion 1E that is integral with the carriage. Thus, the large space 3E permits the protrusion 1E integrally formed from carriage 1 to pass through the space 3E thereby avoiding any unnecessary collisions.

FIG. 1F presents a perspective view of a spring activated adjustable grip used along with the track of FIG. 1B in an embodiment taught herein. A forward portion of each spring 3C is wrapped about or attached (glue, adhesive etc) to a screw 2H that is inserted within an appropriate hole in a mount 2G underneath the track 2. Each screw 2H is placed so that it has its head disposed to the head of the opposite screw 2H. The mounts 2G within which the screws 2H are placed are disposed on an opposite underside of that of mouth 2D and holders 2F.

FIG. 1G presents a side cross section view of the carriage of FIG. 1A mounted on the track of FIG. 1B along section cut 'C' showing an attachment device attached to the carriage through a hole in the track such that this is used to facilitate the sliding function in an embodiment taught herein. A carriage 1 having an integral protrusion 1E on its bottom 1B has a fastener 1G attached thereto. However, in order to permit the sliding action of the carriage 1 upon the base 2A of the track 2, a fastener 1G is first placed through a threaded hole in a mount 1F. Then the fastener 1G proceeds through a threaded hole in the protrusion 1E that itself sits within the rectangular hole 2C in the base 2A; this thereby locks the mount 1F to the protrusion 1E and concomitantly ensures that the carriage 1 is moveably attached to the track 2 as the protrusion 1E slides along the hole 2C in the base 2A.

It should be understood that the mount 1F forms the top portion of a T shape as it engages a bottom of the base 2A by extending beyond the dimensions of the hole 2C to both lateral sides thereof; of course, this has the effect of forbidding disengagement therefrom. It should be apparent that while the mount 1F forms the top portion of the T shape, the protrusion 1E forms the central pillar thereof. As a result, the carriage 1 is now moveably attached to track 2. Alternatives to this attachment scheme is the use of glues, adhesives, cements, plastics, resins or more between 1F and 1E.

FIG. 1H presents a cross section view at lines 'A' of a track from FIG. 1B used in conjunction with the carriage from FIG. 1A in an embodiment taught herein. This portion of the track 2 has the base 2A similarly attached to the longitudinal lateral side walls 2B (or integral therewith). Two mounts 2G (rectangular or square pieces of plastic) are attached to and disposed underneath the track 2 base 2A opposite one another; they are each likewise attached to an inside surface of one of the longitudinal lateral side walls 2B. Alternatively, they are integrally formed with either the base 2A, or with the side walls 2B or both. They each have a screw 2H that is inserted within an appropriate hole in a mount 2G underneath the track 2. Each screw 2H is placed so that it has its head disposed to the head of the opposite screw 2H. The mounts 2G within which the screws 2H are placed are disposed on an opposite underside of that of mouth 2D and holders 2F.

FIG. 1I presents a cross section view at lines 'B' of a track from FIG. 1B used in conjunction with the carriage from FIG. 1A in an embodiment taught herein. Here, the grip 3 has its top surface 3A inserted within mouth 2D atop the holder 2F directly underneath the track 2A. The forward portion of the top flat surface 3A has a spring attached thereto that is also attached to a screw 2H inserted within a mount 2G. The mount 2G is integrally formed or attached to a lateral side wall 2B not shown. A forward gripping end is integrally formed from the base 2A.

Figure 2:
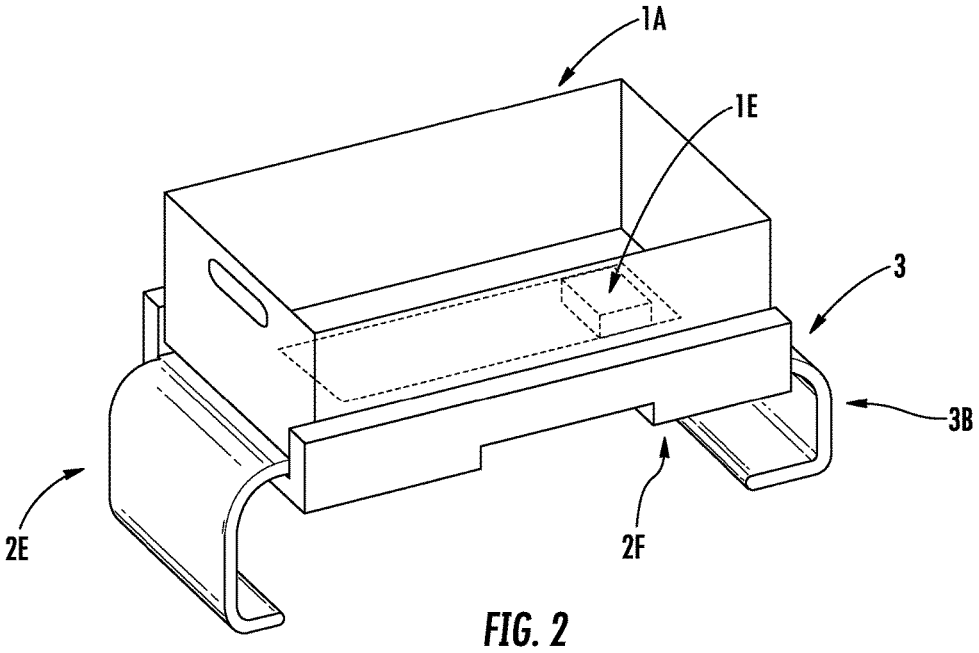
FIG. 2 presents a perspective view of a carriage upon a track having an integral gripping end and an adjustable grip 3 moveably associated therewith.

FIG. 2 presents a perspective view of a carriage 1 upon a track 2 having an integral gripping end and an adjustable grip 3 moveably associated therewith.

The various components herein described are attachable using glue, adhesives, heat treatment, fasteners, screws or similar modalities as long as that attachment facilitates the function of providing for a movable adjustable gripping device inserted within a mouth of the track; and that the carriage whilst attached to the track is moveably attached thereto along the track. Further, the overall system may be situated with the adjustable grip 3 near the refrigerator (to the front thereof) opening/door or disposed with the adjustable grip 3 away from the door to the far side of the shelf at the interior back of the refrigerator.

What is claimed is:

1. A refrigerator containment system comprising:

a track having:

a base having a top surface bordered by:

an integral first wall immovably disposed and integral with respect to a first side of the base; and an integral second wall immovably disposed and integral with respect to a second side of the base opposite the first wall;

an adjustable grip moveably attached to the track at a first end thereof between the first integral and second integral walls; and a carriage moveably attached to the track between the first integral wall and the second integral wall so that the carriage is bounded by the integral first wall and the integral second wall;

a fixed gripping end integrally attached to the base at a second end of the track opposite the first end having the adjustable grip moveably attached thereto;

a hole in the base wherein the carriage is moveably attached to the base using a T shaped mount;

a fastener moveably attaching a bottom of the carriage through the hole in the base.

2. A refrigerator containment system comprising:

a track having:

a base having a top surface bordered by:

an integral first wall immovably disposed and integral with respect to a first side of the base; and an integral second wall immovably disposed and integral with respect to a second side of the base opposite the first wall;

an adjustable grip moveably attached to the track at a first end thereof between the first integral and second integral walls; and a carriage moveably attached to the track between the first integral wall and the second integral wall so that the carriage is bounded by the integral first wall and the integral second wall;

a mouth on a side of the track within which the adjustable grip is inserted wherein the mouth is formed between the first and second side walls that descend down about a bottom surface of the base that is opposite the top surface of the base; and a first and a second ledge extending inwards towards each other wherein the first ledge is integral with and extends inwards from the first side wall and the second ledge is integral with and extends inwards from the second side wall;

a first spring attachment support attached to the first ledge.

3. The refrigerator containment system of claim 2, further comprising:

a first spring attached to the first spring attachment support and to the adjustable grip.

4. The refrigerator containment system of claim 3, further comprising:

a second spring attachment support attached to the second ledge.

5. The refrigerator containment system of claim 4, further comprising:

a second spring attached to the second spring attachment support and to the adjustable grip.

* * * * *